United States Patent [19]

Bhat et al.

[11] 4,088,105

[45] May 9, 1978

[54] GLOW PLUG

[75] Inventors: Vasanth K. Bhat, Cincinnati; Allen E. Siegel, Loveland; Richard E. Vogel; Larry G. Burrows, both of Cincinnati, all of Ohio

[73] Assignee: Emerson Electric Co., St. Louis, Mo.

[21] Appl. No.: 594,560

[22] Filed: Jul. 9, 1975

[51] Int. Cl.[2] ..... F02P 19/00

[52] U.S. Cl. ..... 123/145 A; 123/145 R

[58] Field of Search ..... 123/143 R, 143 A, 143 B, 123/145 R, 145 A, 169 EL; 60/39.82 N; 317/94, 98; 313/137, 144

[56] References Cited

U.S. PATENT DOCUMENTS

| | | | |
|---|---|---|---|
| 1,129,603 | 2/1915 | Quackenbush | 123/169 EL |
| 1,577,483 | 3/1926 | Morrison | 123/145 A |
| 3,232,055 | 2/1966 | Saintsbury | 60/39.82 N |
| 3,689,195 | 9/1972 | Beesch et al. | 123/145 A X |

FOREIGN PATENT DOCUMENTS

| | | | |
|---|---|---|---|
| 1,212,076 | 3/1960 | France | 123/145 R |
| 7,246,908 | 3/1973 | Germany. | |
| 7,414,192 | 8/1974 | Germany. | |
| 861,275 | 2/1961 | United Kingdom | 123/145 A |

*Primary Examiner*—Charles J. Myhre
*Assistant Examiner*—Tony M. Argenbright
*Attorney, Agent, or Firm*—Polster, Polster and Lucchesi

[57] ABSTRACT

In a glow plug igniter of the type used in internal combustion engines, having a hollow cylindrical casing and a central pin-terminal, a substantially flat-spiral-coiled, flexible resistance element, oriented perpendicularly to said pin-terminal with one end electrically connected to the casing and the other to the pin-terminal, is positioned at a nose end of the casing and spaced from but close to a backing seal of temperature and corrosion-resistant material. At least one seal hermetically closes the hollow casing. Preferably, spaced glass seals constitute the sole means for mounting the pin in the body.

12 Claims, 5 Drawing Figures

GLOW PLUG

BACKGROUND OF THE INVENTION

This invention has particular but not exclusive application to glow plugs used in internal combustion engines of model airplanes used for racing.

Model airplane engines used in racing are two-cycle engines fueled with exotic fuels which burn at high temperatures. The engines conventionally turn at 20,000 rpm or higher. The engines are started by attaching a source of current to the center pin and ground of a glow plug, but immediately after they are started, the source of electrical energy is removed, and the continued running of the engine is dependent for ignition upon the retention of sufficient thermal energy from one power stroke to another by the plug. The general type of engine, but with an early type glow coil is illustrated and described in Howie, U.S. Pat. No. 2,138,301.

In conventional glow plugs now used for this purpose, a terminal pin, with an annular flange on it projecting radially from the pin intermediate the ends of the pin, is mounted in a hollow cylindrical body. The pin is insulated from the body by plastic or fiber insulators, and is held in place by a mechanical crimp or threaded sleeve. Early versions of the plug, such as are illustrated and described in Arden, U.S. Pat. No. 2,482,831 had threaded retainers, but common practice at present is to have a smooth bore and cylindrical sleeve or washer, which is held against movement out of the hollow body by a rolled or crimped edge on the body. The terminal pin stops short of the inner or nose end of the body by a substantial distance. A helically coiled resistance element extends substantially axially of the body wholly within the body except for an outer end of the element which extends radially or chordally and overlaps a radially flat inner face of the body, to which it is welded. The other end of the element is welded to the inner end of the pin.

Such plugs have a number of disadvantages. Among other things, they require the assembling of a number of small parts. They tend to reduce the compression in the cylinder, both because they do not form an entirely effective seal, and because they provide in effect a second chamber or well, in which the resistance element is located. More importantly, they expose only an end turn or two, and in any event, a small area, to the gases to be ignited, since most of the element is in the well to which the gases have no easy access. Furthermore, the geometry of the element and its connection to the body of the plug are such that the heat of combustion and pulsations of the explosions in the cylinder tend quickly to cause the element to separate at or near the exterior weld, and to displace the remaining wire of the element into the well or cavity. As a result of the latter, in practice the plug is routinely discarded after one run.

Other configurations of glow plugs have been suggested, but not for the conditions of use to which glow plugs used in model airplane racing engines are subjected. For example, U.S. Pat. to Rabezzana, Nos. 2,149,868 and Klingner, No. 2,205,145 suggest coils or loops projecting totally beyond the nose of a plug. This requires an element of a size and strength which is unacceptable in a motor of the type for which the plug of the present invention is intended. Saintsbury, U.S. Pat. No. 3,232,055 shows a circularly arranged helical element displayed at right angles to the axis of a center pin terminal, the element being supported at four quadrants, in effect making four short, relatively rigid segments.

Rademacher, U.S. Pat. No. 3,434,012 illustrates a flat spiral of ribbon resistance wire oriented at right angles to a center pin, the element being solidly supported by a fluted tubular insulator. The insulator is self-supporting and is mounted in a plug casing. The ribbon, by its nature is somewhat rigid in its "axial" direction, and without support, will tend to break up. With support, an igniter of this type has been found, in the two-cycle racing engine, to involve excessive cooling of the coil. The self-supporting core of Rademacher and those plugs which are described as prior art plugs of this nature also present certain sealing problems. Similarly, Saintsbury, U.S. Pat. No. 3,297,914 discloses a spiral heating element supported by a cross-shaped ceramic support which provides a chamber behind the heating element into which air is drawn through holes to produce a combustible mixture initially and to cool the heating element when the engine for which it is used is in operation. Such a plug has application only to jet and turbine engines in which the plug is not in a cylinder wherein a fuel mixture is compressed.

One of the objects of this invention is to provide a glow plug of the type used in small two-cycle internal combustion engines, in which more efficient ignition is provided than in glow plugs known heretofore, and which is more rugged and durable than glow plugs known heretofore. Other objects will become apparent to those skilled in the art in light of the following description and accompanying drawings.

SUMMARY OF THE INVENTION

In accordance with this invention generally stated, a glow plug igniter of the type used in small two-cycle internal combustion engines is provided in which a substantially flat-spiral-coiled flexible resistance element, oriented perpendicularly to the axis of a terminal pin, is positioned closely adjacent the nose end of the plug. A seal of heat and corrosion resistant material is secured to and completely closes the nose end of the plug immediately behind the resistance element, closely adjacent the element but spaced therefrom through at least a major portion of the radial extent of the element. The nose seal may extend the entire distance to the opposite end of the plug, or a second seal, either contiguous the nose seal or spaced axially from the nose seal, may serve with the nose seal as the sole means for mounting the terminal pin the plug body. In the preferred embodiment, at least one of the nose seal and second seal, if a second seal is employed, is vitreous or partially crystallized glass and is fused and bonded to the plug wall and terminal pin to form a hermetic seal.

DESCRIPTION OF THE PREFERRED EMBODIMENT

Figure 4:
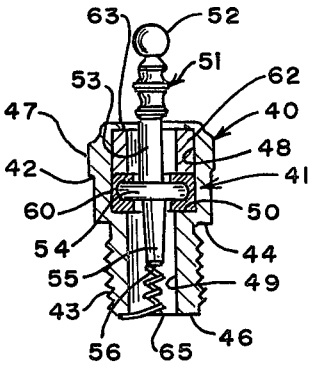
FIG. 4 is a sectional view of one form of conventional glow plug.

Referring now to the drawing, and particularly to FIG. 4, reference numeral 40 indicates a conventional glow plug for use in two-cycle racing engines for model airplanes. The glow plug 40 has a casing 41 with a body section 42 and a nose section 43 of a smaller diameter than the body section to define an annular shoulder 44 between them. The nose section is threaded, and has a flat radial end face 46. The body section has a hex nut 47 formed integrally on its outer wall, and a bore 48 of a diameter greater than a bore 49 of the nose section, to define between them an annular seat 50. A terminal pin 51 is centered in the concentric bores 48 and 49. The terminal pin 51 has a ball 52 at its outer end, to which a conventional quick disconnect electrical fitting can be attached, a shank portion 53, an annular outwardly radially extending flange 54, and a tapered shaft section 55 terminating in a flat end surface 56.

The pin 51 is mounted in the body of the plug by means of plastic or fiber insulators 60, upper and lower ones of which together form a ring, U-shaped in cross section to form a channel within which the flange 54 is seated. The insulators 60 are seated on the seat 50 and bear against the inside surface of the bore 48. The insulators, hence the flange and pin, are held in place within the body by means of a spacing sleeve 62, which in turn is held against axially outward movement by a rolled edge 63 of the body section 42.

A helical resistance element 65, one end of which is welded to the end surface 56 of the terminal pin, and the other end of which is welded to the end face 46 of the nose section of the plug, extends for the most part axially of the bore 49. It will be observed that between the flange 54 and the nose end face 46, the bore 49 is substantially open, and that almost all of the resistance element 65 lies within the confines of the bore 49.

Figure 2:
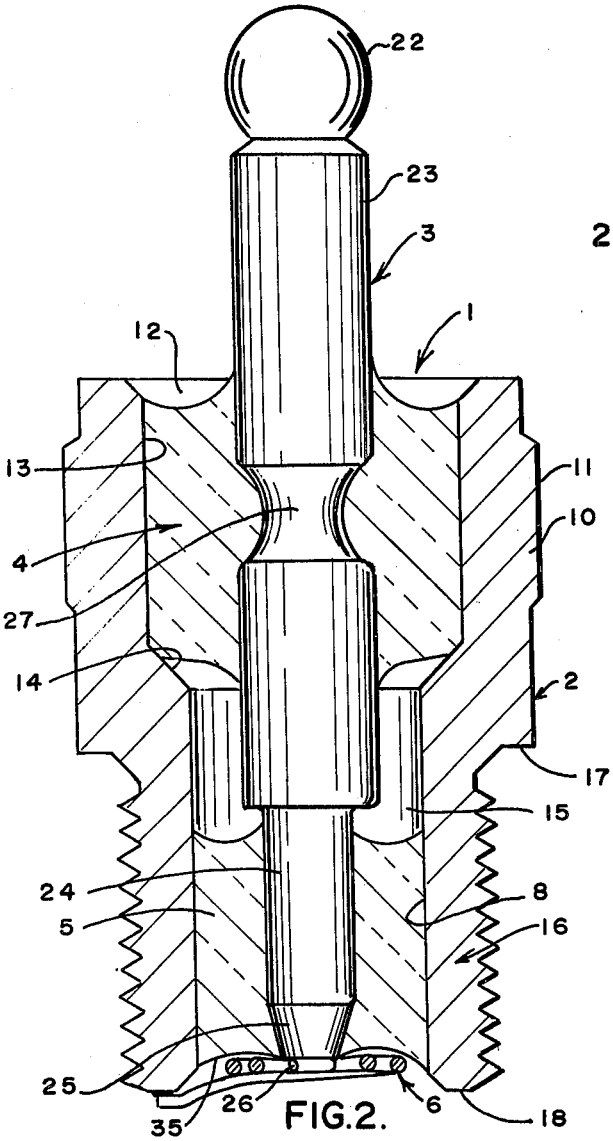
FIG. 2 is a sectional view taken along the line 2—2 of FIG. 1.
Figure 1:
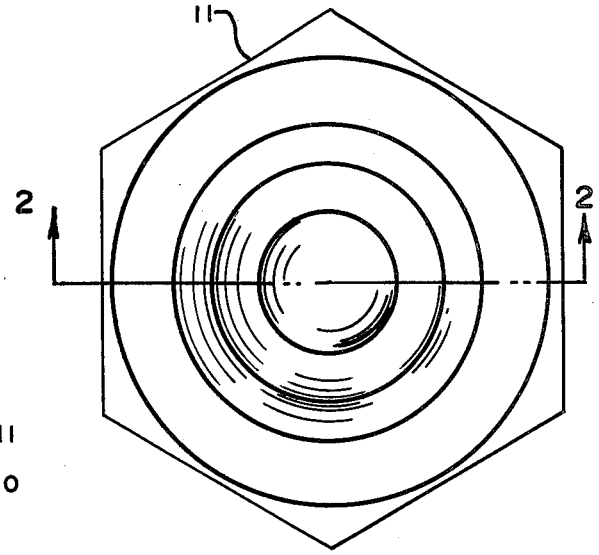
FIG. 1 is a top plan view of one illustrative embodiment of glow plug of this invention.
Figure 3:
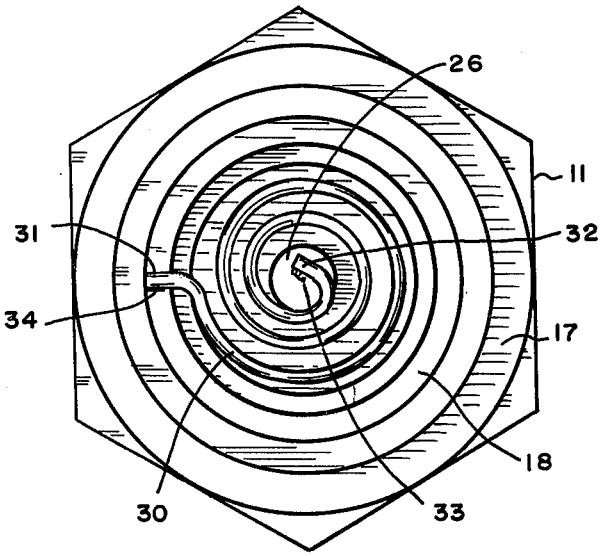
FIG. 3 is a bottom plan view of the device shown in FIGS. 1 and 2.

Referring now to FIGS. 1–3 for one illustrative embodiment of glow plug of this invention, reference numeral 1 indicates the glow plug. The glow plug is made up of a casing 2, a terminal-pin 3, an outboard seal 4, an inboard or nose seal 5 and a resistance element 6.

The casing 2 has a body section 10 and a nose section 16. The body section has a hex nut 11 formed integrally with it on its outside, a bore or chamber 12 defined by cylindrical side wall 13 and a shoulder 14, connecting the side wall 13 to a side wall 8 of the nose section 16. The side wall 8 defines a bore 15 of smaller diameter than the diameter of the bore or chamber 12. The outer surface of the nose section is threaded conventionally. The nose section 16 is of smaller diameter than the outside diameter of the body section 10, defining between them a shoulder 17 which is also conventional. The nose section 16 has on its inboard end a radially flat surface 18. Both the nose and the body may have internal chamfers at the outer ends of the bores 12 and 15 respectively.

The terminal pin 3 has a ball 22 at its outer end, corresponding to the ball 52 of the conventional glow plug shown in FIG. 4. The pin has a heavy cylindrical shank section 23, a relatively short reduced shaft section 24 with an annular bevel 25 at its lower end, and a flat radial end surface 26. In the embodiment shown, the shank 11 is provided with an annular groove 27 about midway axially of the seal 4. The shank 11 can also be straight sided, or provided with a plurality of annular grooves.

The resistance element 6 of this embodiment is an elongated wire 30, wound in a flat spiral configuration. It has an outer end 31, extending out of the plane of the rest of the spiral in order to overlap the flat face 18 of the nose section of the casing, welded at 34 to the flat face 18, and an inner end 32, welded at 33 to the flat end 26 of the terminal pin.

In this embodiment, the outboard seal 4 is a glass seal fused to the side wall 13 of the casing and to the shank 23 of the pin. The nose seal 5 is also a glass seal, fused to the side wall 8 of the casing and to the shaft section 24 of the pin. The glass nose seal 5 may be made more refractory by the addition to the glass of 5 to 25% crystalline ceramic particles. The outboard seal 4 can also contain crystalline ceramic additives. In any event, the fusing and bonding characteristics are those of glass, and the term glass is used herein to embrace any composition in which glass predominates, regardless of the amount or character of other additives.

The wire making up the spiral element 6 is spaced slightly from the adjacent surface of the seal 5.

It will be observed that the inboard and outboard seals, fused to the walls 8 and 13 and the shaft and shank sections 24 and 23, respectively, constitute the sole means for mounting the pin 3 within the casing 2.

In the manufacture of the plug of this embodiment, two annular, cylindrical, sintered pellets essentially of powdered glass but with any desired additives such as alumina in the nose seal pellet and of the desired size are positioned around the pin 3 and within the bores of the casing 2, and the assembly heated to fuse the glass to the pin and bore walls. The spiral element 6, which, in this embodiment, is made of platinum rhodium wire, can simply be laid in position with the end 31 on the nose surface 18 and the end 32 on the pin surface 26, and welded after the rest of the plug has been assembled.

Figure 5:
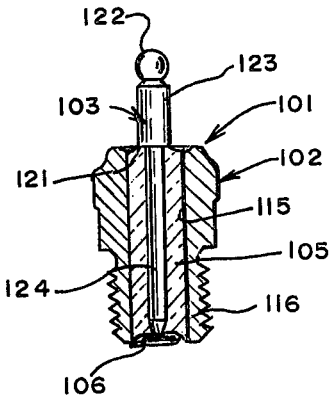
FIG. 5 is a sectional view of another embodiment of glow plug of this invention.

Referring now to FIG. 5 for another embodiment of glow plug of this invention, reference numeral 101 indicates the complete plug which includes a casing 102, a pin-terminal 103, a single seal 105 and a resistance element 106. Externally, the casing 102 can be substantially the same as the casing 2 of the embodiment of FIGS. 1–3. Internally, the casing 102 is shown as having a single cylindrical bore 115 extending axially through the casing. The pin-terminal 103 has a shaft 124 extendng axially through most of the length of and concentricly with the bore 115. The pin-terminal has a heavy shank 123 projecting from the outer end of the casing 102 and is provided at its outer end with a terminal ball 122.

The seal 105 extends from the open end of a nose section 116 of the casing 102 to the outer end of the casing, is fused to the side wall of the bore 115 and to the shaft 124 to form a hermetic seal. The seal 105 also fuses to the surface of an annular shoulder 121 formed between the shank 123 and the shaft 124, so that the external appearance of the finished plug is substantially the same as that of the plug of the first embodiment. The element 106 can be identical in size, shape and configuration with the element 6 of the first embodiment, and its position with respect to the nose surface of the seal 105 is the same as the position of the element in the first embodiment with respect to the nose seal 5. The embodiment of FIG. 5 has some advantage of simplicity over the first embodiment but it does not permit quite as much flexibility in construction as far as the use of different types of nose and outer seals is concerned.

Two different seals can be used with either type of casing and terminal pin, formed in such a way as to abut, with or without fusing together at their abutting surface, but in either event, leaving no intervening space.

As has been indicated above, in the conventional plug, the geometry of the resistance element is such as to permit large movement of the element in a direction away from the nose end of the casing. This distortion of the element leads to separation.

In the plug of any of the embodiments of this invention, it can be seen that the surface area of the element 6 is more directly exposed to the gases to be ignited than that of the helical element of conventional plugs. Furthermore, the geometry of the spiral is such as to make the element flexible, but at the same time, the backing of the nose seal surface prevents excessive movement of the element. As has been stated, it is important that the element be free of direct contact with the nose seal surface through all or most of its radial reach in its initial state. In operation, the element may well be forced momentarily against the nose seal surface but the movement is so slight as not to deform the element detrimentally against the surface of the seal. At the same time, the shallow, dished recess of the nose seal not only appears to provide some protection to the element, but to tend to prevent shorting of intermediate reaches of the element to ground on the casing.

It will be seen that with the construction of the glow plug of this invention, practically no increase in volume of the cylinder is produced, that no compression can be lost through the glass seal or seals, and that all of the resistance element is exposed to the gases to be ignited.

It has been found that contrary to the experience with conventional plugs, a plug constructed in accordance with the embodiment described may be used more than once, and has produced substantially higher speeds of rotation in the same engine than that achieved by conventional glow plugs.

As a result of the resistance of the glass nose seal of the plug of this invention to corrosion, including thermal degradation, and the durability of the element with the configuration and backing of the element of this invention, it has been possible to use "hotter" fuel than is generally used with conventional plugs, e.g. fuels containing up to 82% nitro-methane.

Merely by way of illustration, in a glow plug 1 0.710 inches long with a plug casing 2 0.470 inches long, a nominal major diameter of the threaded nose section 16 of 0.250 inches and a root diameter of 0.223 inches, an inside diameter of the body chamber 12 of 0.209 inches and of the nose bore 15 of 0.156 inches, the nose bore extending 0.293 inches from the outer nose surface 18 to the edge of the chamfer 14, a pin 3 0.690 inches long with a shank 23 0.094 inches in diameter and a shaft 24 0.062 inches in diameter, beveled at its free end to provide a radial flat surface 26 0.039 inches in diameter, the pin surface 26 can be recessed 0.020 inches from the plane of the flat nose surface 18. The wire 30 can be 80% platinum, 20% rhodium, 0.008 inches in diameter and 0.850 inches long, coiled so as to form a flat spiral 0.110 inches across at the point at which the outer end 31 leaves the plane of the spiral and 0.062 inches from the center of the plug to the point at which the outer end 31 is bent to project substantially radially outwardly. The projection of the outer free end or tang cannot be so great as to interfere with the thread minor diameter.

The distance between the surface of the nose seal meniscus 35 and the undersurface of the spiral can be in the neighborhood of 0.001 to 0.005 inches, making the distance from the plane of the nose face 18 to the most dished part of the meniscus on the order of 0.025 inches.

It can be seen that the volume of the nose section cavity between the nose surface 18 and the surfaces 35, 26 closing the nose bore is on the order of magnitude of substantially less than one tenth the volume added to the cylinder volume by conventional glow plugs.

Numerous variations in the construction of the glow plug of this invention within the scope of the appended claims will occur to those skilled in the art in the light of the foregoing disclosure. Merely by way of example, the configuration of the pin and plug casing can be changed. Different alloys can be used in the spiral element and, while a round wire is preferred, wire of other cross-sectional shapes can be used to form the spiral provided that the resulting shape has sufficient flexibility within the limits set by the spacing from the nose seal and geometry of the spiral to avoid shattering in use. The seals can be of material different from glass, provided, however, that the nose seal must be of material which is resistant to heat and corrosion and preferably is capable of being sealed hermetically to the side wall of the nose bore and to the shaft of the pin. Certain high temperature plastics, either heavily loaded with ceramic material or used to cement ceramic cores may be employed, although, for many reasons, the glass seals are preferred, particularly for the nose seals. Suitable glass seal sintered pellets are made by Fusite Division, Emerson Electric Co. and Glass Seal Company.

It is also possible to metallize and braze in place, or glass-coat and fuse in place, or join with a glass pellet, a ceramic washer to form a nose seal.

The blocks of most model airplane engines are made of aluminum and provided with integral cooling fins, which makes them effective heat sinks. This adds to the problem of efficient ignition with conventional plugs, but it makes the thermal requirements of the outer seal less stringent than those of the nose seal, particularly in the construction of the plugs of the preferred embodiments of this invention, where the outer seal is protected by the hermetic closure of the nose seal. Accordingly, while a glass seal is preferred, the outer seal can be made of suitable plastic or the like. These variations are merely illustrative.

Having thus described the invention, what is claimed and desired to be secured by Letters Patent is:

1. In a glow plug ignitor of the type used in small two-cycle internal combustion engines, having a hollow cylindrical casing and a central pin-terminal, the improvement comprising a substantially flat-spiral-coiled, flexible resistance element one end of which is electrically connected to said casing and the other to said pin-terminal, said element being oriented substantially perpendicularly to the axis of said pin-terminal and being normally substantially free of support between the said pin-terminal and said casing, a glass seal, fused to an interior wall of said hollow casing and to said pin-terminal and having a surface immediately behind said resistance element, closely adjacent said element but spaced therefrom through at least a major portion of the radial extent of said element, the spiral reaches of said element between the two ends thereof being radially inboard of said casing.

2. The improvement of claim 1 wherein the said glass seal is taken from the class consisting of vitreous and partially crystallized glass.

3. The improvement of claim 1 wherein a second seal is provided, spaced from said first seal in a direction away from said resistance element, said first and second seals constituting the sole means for mounting said pin in said body.

4. In a glow plug ignitor of the type used in a small two-cycle internal combustion engine, having a cylindrical casing and a central pin-terminal, said casing having a passage extending axially through it and a nose section intended to communicate with a cylinder of said engine, the improvement comprising an electrically insulating seal bonded to a passage defining wall of said casing and to said pin-terminal, electrically insulating said pin from said casing and hermetically closing the passage in said casing, and a surface of heat and corrosion resistant material, recessed within said passage slightly as compared with the total length of the passage, from the outboard end of said nose section; and a substantially flat-spiral-coiled, flexible resistance element one end of which is electrically connected to said pin-terminal and the other end of which is electrically connected to said casing, said element being oriented substantially perpendicularly to the axis of said pin-terminal and being normally closely adjacent said surface but spaced therefrom through at least a major portion of the radial extent of said element, the spiral reaches of said element between the two ends thereof being radially inboard of the passage-defining surface of said casing at the outboard end of said nose section.

5. The improvement of claim 4 wherein the said surface is dished concavely in an annulus between the casing and the pin terminal.

6. The improvement of claim 4 wherein the said surface constitutes a part of the said seal.

7. The improvement of claim 6 wherein the seal is unitary and extends through sustantially the full length of the passage.

8. The improvement of claim 4 wherein the surface constitutes a part of a seal different from said hermetic seal.

9. The improvement of claim 4 wherein a plurality of hermetic seals is provided, of one of which said surface constitutes a part.

10. The improvement of claim 9 wherein the said seals are of different compositions.

11. The improvement of claim 9 wherein the seals are spaced from one another.

12. The improvement of claim 4 wherein the said surface of heat and corrosion resistant material is of a composition different from said hermetic seal.

* * * * *